US005765078A

United States Patent [19]

Yamamoto et al.

[11] Patent Number: 5,765,078

[45] Date of Patent: Jun. 9, 1998

[54] IMAGE DEVELOPING APPARATUS TO PREVENT GENERATION OF ODOR AND SCATTER OF DEVELOPING MATERIAL

[75] Inventors: Takemi Yamamoto, Nagoya; Yuji Hiraoka, Tokorozawa, both of Japan

[73] Assignee: Brother Kogyo Kabushiki Kaisha, Nagoya, Japan

[21] Appl. No.: 689,500

[22] Filed: Aug. 7, 1996

[30] Foreign Application Priority Data

Aug. 7, 1995 [JP] Japan ..... 7-201140

[51] Int. Cl.[6] ..... G03G 15/10

[52] U.S. Cl. ..... 399/239; 399/237

[58] Field of Search ..... 399/237, 238, 399/239, 240, 241; 347/20, 55, 85, 111, 112

[56] References Cited

U.S. PATENT DOCUMENTS

| | | | |
|---|---|---|---|
| 3,446,649 | 5/1969 | Degenhardt et al. . | |
| 3,461,843 | 8/1969 | Noon et al. . | |
| 4,193,682 | 3/1980 | Muller et al. | 399/241 |
| 4,751,532 | 6/1988 | Fujimura et al. . | |
| 5,017,968 | 5/1991 | Oikawa | 399/241 |
| 5,144,340 | 9/1992 | Hotomi et al. . | |
| 5,355,201 | 10/1994 | Hwang | 399/241 |
| 5,477,249 | 12/1995 | Hotomi | 347/55 |
| 5,519,473 | 5/1996 | Morehouse, Jr. et al. | 399/239 |

FOREIGN PATENT DOCUMENTS

| | | |
|---|---|---|
| 1910236 | 9/1970 | Germany . |
| A-62-5282 | 1/1987 | Japan . |
| A-62-5283 | 1/1987 | Japan . |
| B2-64-2943 | 1/1989 | Japan . |
| A-2-259778 | 10/1990 | Japan . |
| A-3-78781 | 4/1991 | Japan . |
| 1028857 | 5/1966 | United Kingdom . |
| 1071965 | 6/1967 | United Kingdom . |
| 1540041 | 2/1979 | United Kingdom . |

*Primary Examiner*—Sandra L. Brase
*Attorney, Agent, or Firm*—Oliff & Berridge, PLC.

[57] ABSTRACT

The image developing part 10 is constructed from the developing agent storing part 20 storing the fluid developing agent 18 and the developing agent supplying part 22 confronting the surface of the photosensitive drum 12 via the minute opening 25. The developing agent supplying part 22 includes a pair of, upper and lower, flat plates 24*a* and 24*b* which are placed in parallel and which define the uniform minute opening 25 over an entire width of the photosensitive drum 12. The flat plates 24*a* and 24*b* are formed with the electrodes 26*a* and 26*b*, respectively. It is possible to finely adjust the gap between the flat plates 24*a* and 24*b* through operating the minute displacement actuator 28 placed at the gap between the flat plates 24*a* and 24*b*. It is therefore possible to control the pressure to be exerted upon the fluid developing agent 18.

21 Claims, 4 Drawing Sheets

IMAGE DEVELOPING APPARATUS TO PREVENT GENERATION OF ODOR AND SCATTER OF DEVELOPING MATERIAL

BACKGROUND OF THE INVENTION

1. Field of the Invention

The present invention relates to an image developing apparatus employed in an image-forming apparatus, such as printers, copy machines, and facsimile machines. More specifically, the present invention relates to an image developing apparatus for making visible an electrostatic latent image formed on a surface of an image bearing body and for producing a hard copy.

2. Description of the Related Art

There have been proposed various methods for developing an electrostatic latent image through having an electrostatic latent image formed on a surface of an image bearing body contacted with fluid developing agent.

One type of image developing apparatus is described in Japanese Patent Application Publication Kokai No. Hei-3-78781. In this apparatus, a developing electrode is located at a position in close contact with a photosensitive drum on which an electrostatic latent image is formed. Positively-charged liquid toner is supplied by a pump onto the developing electrode from a toner tank. The liquid toner therefore leaks out onto the developing electrode. The positively-charged liquid toner is attracted toward the surface of the photosensitive drum through an electric field established between the developing electrode and the electrostatic latent image on the photosensitive drum. The liquid toner adheres to the photosensitive drum, and makes visible the electrostatic latent image. The liquid toner adhered to the surface of the photosensitive drum is then transferred to a recording sheet by a corona transferring equipment.

Another type of image developing apparatus is described in Japanese Patent Application Publication Kokai No. Hei-2-259778. In this apparatus, a pump supplies developing liquid to a developing roller so that the developing liquid is soaked in the developing roller. The developing liquid is attracted from the developing roller toward a photosensitive drum via an electric field established between the developing roller and the photosensitive drum. The developing liquid adheres to the photosensitive drum, and makes visible a latent image formed on the photosensitive drum.

Japanese Patent Application Publication Kokai No. Sho-59-26766 describes still another type of image developing apparatus. A light-exposed image recording medium is introduced into a developing sink filled with developing liquid. A developing electrode, provided in the developing sink, develops a latent image formed on the image recording medium.

In the above-described image developing apparatuses, developing liquid is caused to leak on the surface of the developing electrode, soaked in the developing roller, or stored in the developing sink. Smell is generated when the developing liquid evaporates or volatilizes.

Developing liquid may possibly splash or drip when it is transferred to the photosensitive drum from the developing electrode or the developing roller.

When image forming apparatuses employed with the above-described image developing apparatuses are moved from one position to another, the inner part of the image forming apparatus will possibly become dirty as developing liquid leaks out of the image developing apparatus.

In order to solve the above-described problems, the image developing apparatuses are provided with large-sized, complex devices. For example, in order to remove smell, the apparatus is mounted with a fan for exhausting air from the apparatus, and a smell-absorbing filter is attached to the fan. Other various devices have to be mounted to the apparatus for preventing the scatter of the developing liquid. Accordingly, the entire image forming apparatus employed with the image developing apparatus becomes large and heavy. The image forming apparatus becomes expensive.

SUMMARY OF THE INVENTION

The present invention is attained to solve the above-mentioned problems, and an object of the present invention is to provide an improved image developing apparatus which can sufficiently prevent generation of smell and scatter of developing material and which is still small in size, light in its weight, and can be produced less costly.

In order to attain the above object and other objects, the present invention provides an image developing apparatus for developing a latent image into a visible image, the apparatus comprising: an image bearing body for bearing an electrostatic latent image, the image bearing body having a predetermined recording width, the image bearing body moving in a direction substantially perpendicular to the widthwise direction; developing agent supplying means placed confronting the surface of the image bearing body for supplying fluid developing agent to the image bearing body, the developing agent supplying means including means for defining a uniform minute opening extending substantially in parallel to the widthwise direction and developing agent protruding means capable of making the fluid developing agent uniformly protrude out of the minute opening along the widthwise direction.

The developing agent protruding means preferably includes adjusting means for adjusting an amount of the fluid developing agent protruding from the minute opening into a first condition in which the fluid developing agent is in contact with the surface of the image bearing body and into a second condition in which the fluid developing agent is out of contact with the surface of the image-bearing body.

According to another aspect, the present invention provides an image developing apparatus for developing a latent image into a visible image, the apparatus comprising: an image bearing body for bearing an electrostatic latent image; means for defining a minute opening confronting the image bearing body; and developing agent protruding means for controlling fluid developing agent to protrude out of the minute opening into contact with the image bearing body.

The developing agent protruding means preferably includes adjusting means for adjusting an amount of the fluid developing agent protruding from the minute opening into a first condition in which the fluid developing agent is in contact with the surface of the image bearing body and into a second condition in which the fluid developing agent is out of contact with the surface of the image-bearing body.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
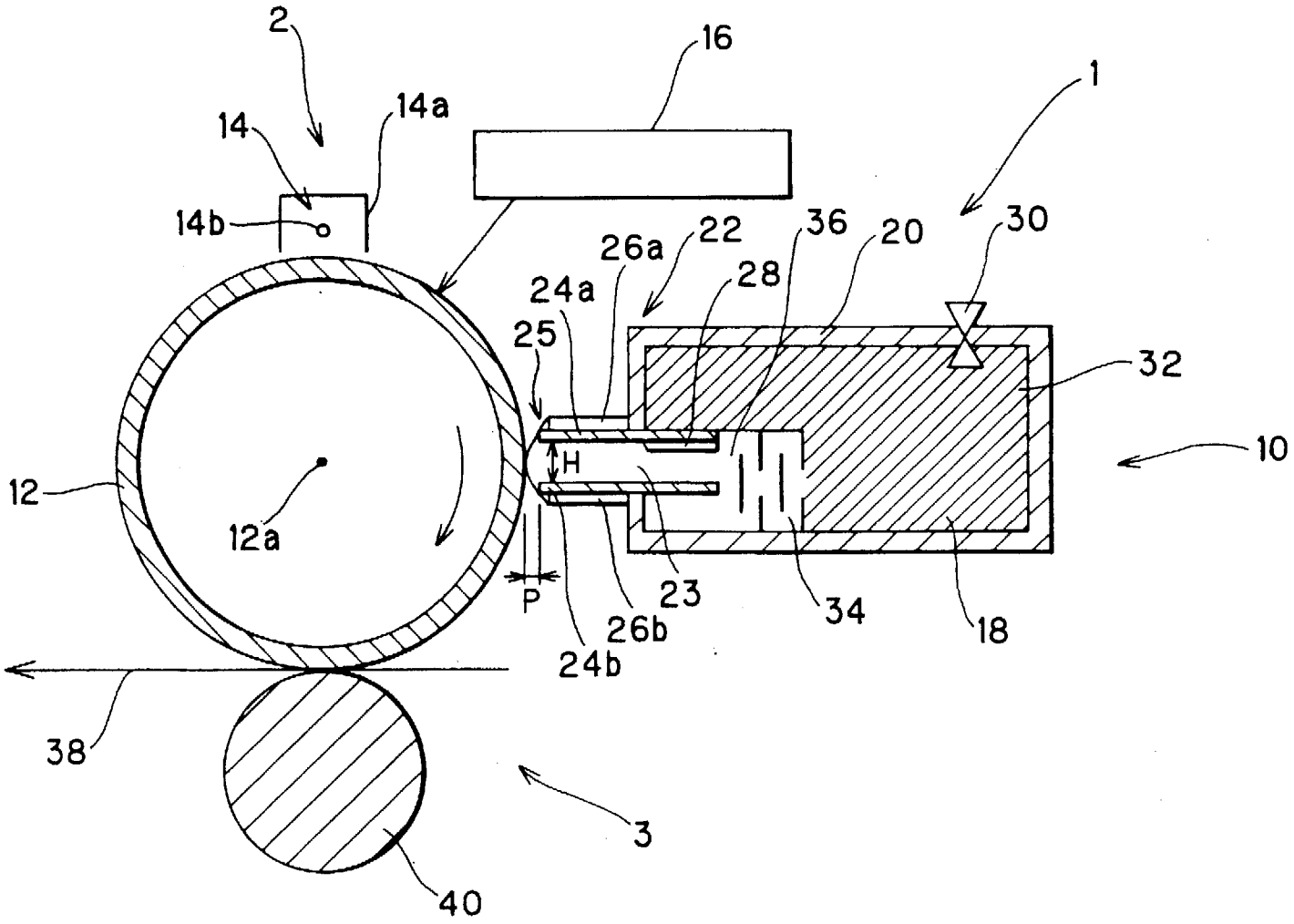
FIG. 1 is a sectional view of an image developing apparatus according to a preferred embodiment of the present invention wherein a fluid developing agent protrudes from a slot during a developing operation.

An image developing apparatus according to a preferred embodiment of the present invention will be described while referring to the accompanying drawings wherein like parts and components are designated by the same reference numerals to avoid duplicating description.

Figure 2:
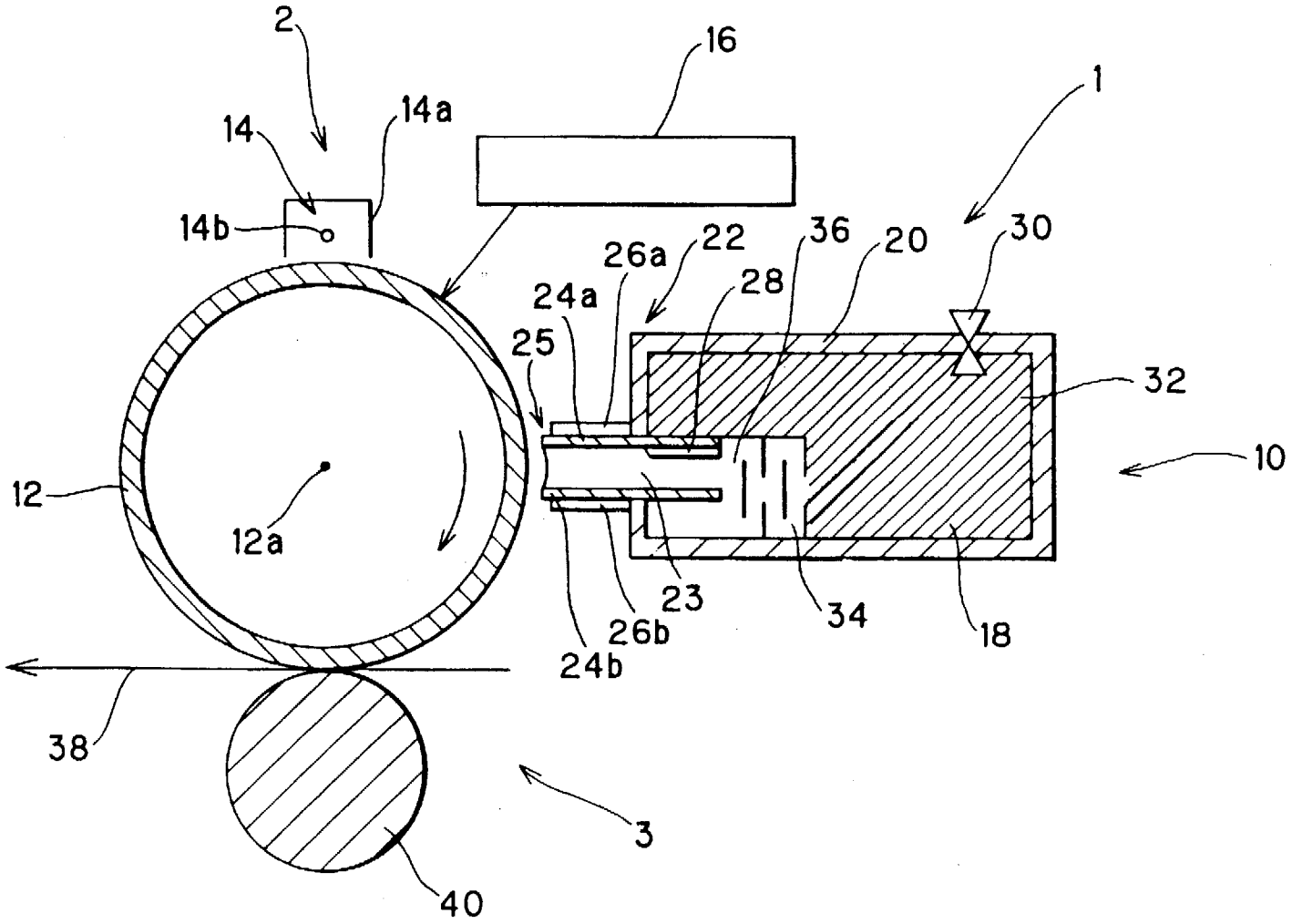
FIG. 2 is a sectional view of the image developing apparatus of the embodiment wherein the fluid developing agent does not protrude from the slot while developing operation is not performed.

FIGS. 1 and 2 are sectional views of a printer (image forming apparatus) 1 to which the image developing apparatus of the present invention is applied.

As shown in FIG. 1, the printer 1 includes: an electrostatic latent image forming part 2; an image developing part 10; and an image transferring part 3. Although not shown in the drawing, the printer 1 further includes a sheet-supplying mechanism, a sheet-transporting mechanism, and an image-fixing mechanism which have structures the same as those used in conventional image forming apparatuses. The explanation of these elements are therefore omitted.

The latent image forming part 2 is for forming a latent image on a photosensitive drum 12. The image developing part 10 is for developing, with a fluid developing agent 18, the latent image formed on the photosensitive drum 12. The image transferring part 3 is for transferring the developed image from the photosensitive drum 12 to a recording sheet 38 which is supplied from a sheet cassette (not shown) by the sheet-supplying mechanism and which is transported to the image transferring part 3 by the sheet-transporting mechanism. The visible image thus transferred on the sheet 38 is then fixed by the image-fixing mechanism and is discharged out of the apparatus through a discharge outlet (not shown).

The electrostatic latent image forming part 2 includes: the photosensitive drum 12 serving as an image-bearing body; a scorotron charger 14 serving to electrically charging the photosensitive drum 12; and a laser scanner 16 serving to expose the photosensitive drum 12 to laser light.

The photosensitive drum 12 is of a cylindrical shape elongated along its axis 12*a*. The axis 12*a* of the photosensitive drum 12 extends perpendicular to the sheet of drawing. The photosensitive drum 12 has a predetermined width along the axial direction 12*a* in which the photosensitive drum 12 is elongated. The photosensitive drum 12 is constructed from, for example, an aluminum tube with its circumferential surface being deposited with an amorphous selenium photosensitive layer. The photosensitive drum 12 is mounted rotatable about the axis 12*a* in a direction indicated by an arrow in the drawing.

The scorotron charger 14 is for electrically charging the surface of the photosensitive drum 12 uniformly. The scorotron charger 14 is constructed from a casing 14*a* and a discharging wire 14*b* surrounded by the casing 14*a*. The discharging wire 14*b* extends substantially parallel to the axis 12*a* of the photosensitive drum 12. The discharging wire 14b extends over an entire width of the photosensitive drum 12. The discharging wire 14*b* is applied with a fixed value of high electric voltage. Accordingly, as the photosensitive drum 12 rotates, the surface of the photosensitive drum 12 is uniformly charged with the fixed value of electric potential. In this example, the scorotron charger 14 negatively charges the surface of the photosensitive drum 12. Accordingly, the photosensitive drum 12 is induced with a uniform surface electrical potential of a negative polarity.

The laser scanner 16 is comprised of: a semiconductor laser (not shown in the drawing); a deflector (not shown) such as a polygon mirror and a galvano mirror for deflecting laser light emitted from the semiconductor laser; and an optical imaging system (not shown) for imaging the deflected laser light into a spot on the photosensitive drum 12.

The semiconductor laser is turned on and off according to image data representative of an image desired to be formed. The deflector deflects the laser light emitted from the semiconductor laser in a direction parallel to the axis 12*a*. The optical imaging system images the deflected light into a beam spot on the surface of the photosensitive drum 12. The absolute value of the surface electric potential on the photosensitive drum 12 decreases at portions where the spot of light is irradiated. An electrostatic latent image is therefore formed on the photosensitive drum 12 as a pattern of the surface electric potential.

The image development part 10 is provided at a downstream side of the laser scanner 16 in the rotating direction of the photosensitive drum 12. The image developing part 10 is constructed from: a developing agent storing part 20 for storing fluid developing agent 18 and a developing agent supplying part 22 for supplying the fluid developing agent 18 from the storing part 20 to the surface of the photosensitive drum 12. The developing agent supplying part 22 is provided to a lower portion of the developing agent storing part 20. The developing agent supplying part 22 is provided in confrontation with the surface of the photosensitive drum 12 with a small gap formed therebetween.

The developing agent storing part 20 is constructed from a tank 32 for storing the fluid developing agent 18. A valve 30 is provided at a top wall of the tank 32 for adjusting pressure applied to the fluid developing agent 18. Various types of valves can be used as the valve 30 for applying pressure to the fluid developing agent 18 in the tank 32. For example, the valve 32 may change the amount of the fluid developing agent 18 introduced into the tank 32 so as to apply pressure to the fluid developing agent 18 in the tank 30. Or, the valve 32 may be constructed to be capable of changing the volume of the tank 30 so as to apply pressure to the fluid developing agent 18 in the tank 30.

The fluid developing agent 18 has fluidity and is produced by mixing a binder and a pigment or a dye into an oil- or water-soluble solvent. Various specific agents may be added to the fluid developing agent 18. For example, the fluid developing agent 18 may be added with a viscosity controlling additive. The fluid developing agent 18 may be added with a surface tension reforming agent. The surface tension reforming agent is for improving the adherence property of the pigment onto a recording sheet 38. It is desirable that the viscosity of the fluid developing agent 18 is equal to or lower than 500 cp.

The developing agent supplying part 22 is constructed from a pair of, upper and lower, flat plates 24*a* and 24*b*. The flat plates 24*a* and 24*b* are inserted through a side wall of the tank 32 at a lower portion thereof. The flat plates 24*a* and 24*b* extend parallel with each other to form a small gap therebetween. A chamber 23 is therefore formed between the plates 24a and 24b in fluid communication with the tank 32. The flat plates 24a and 24b extend substantially parallel to the axis 12a of the photosensitive drum 12. The flat plates 24a and 24b extend over an entire width of the photosensitive drum 12. A narrow slot 25 is defined between tip ends of the flat plates 24a and 24b that confront the photosensitive drum 12. As shown in FIG. 1, a tip end (meniscus) of the fluid developing agent 18 can protrude out of the narrow slot 25.

For example, each of the flat plates 24a and 24b is made of a glass plate with a thickness of about 0.5 mm. The flat plates 24a and 24b are placed to form a uniform gap of about 0.1 mm therebetween. In other words, the chamber 23 and the slot 25 have a uniform small height H of about 0.1 mm over the entire width of the photosensitive drum 12.

Figure 3:
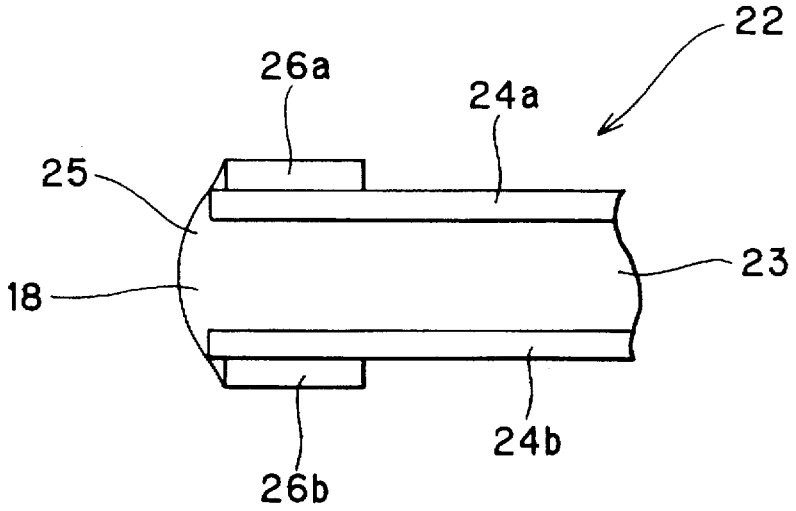
FIG. 3 is an enlarged sectional view of the slot from which the fluid developing agent protrudes in the manner shown in FIG. 1.

An electrode 26a is formed to an upper surface of the upper flat plate 24a, and another electrode 26b is formed to a lower surface of the flat plate 24b. The electrodes 26a and 26b are for electrically charging the fluid developing agent 18 located in the chamber 23, i.e., between the flat plates 24a and 24b. A fixed value of electric voltage is applied to each of the electrodes 26a and 26b. As shown in detail in FIG. 3, when a tip end of the fluid developing agent 18 located in the chamber 23 protrudes out of the slot 25, the fluid developing agent 18 contacts the electrodes 26a and 26b and is electrically charged accordingly. In this example, a direct-current electric voltage in a range of −100 to −200 V is applied to each of the electrodes 26a and 26b so that the fluid developing agent 18 is negatively charged.

A minute displacement actuator 28 is provided between the flat plates 24a and 24b for finely controlling the distance between the flat plates 24a and 24b. The minute displacement actuator 28 can finely control a pressure applied to the fluid developing agent 18 located in the chamber 23.

In this embodiment, the minute displacement actuator 28 is constructed from a piezoelectric element. The minute displacement actuator 28 is provided to the lower surface of the upper flat plate 24a. When applied with an electric voltage, the piezoelectric element deforms and accordingly changes the distance between the flat plates 24a and 24b. The pressure applied to the fluid developing agent 18 changes accordingly.

Thus, the pressure applied to the fluid developing agent 18 can be adjusted through controlling both the adjusting valve 30 and the minute displacement actuator 28. This pressure control can adjust the amount of the fluid developing agent 18 protruding from the slot 25.

It is noted that the minute displacement actuator 28 can control the pressure more precisely than does the pressure adjusting valve 30. It is therefore preferable that the pressure adjusting valve 30 is controlled to keep the tip (meniscus) of the fluid developing agent 18 at a stable condition near the slot 25. The minute displacement actuator 28 is controlled to precisely adjust the protruding amount of the fluid developing agent 18. In this example, the piezoelectric element 28 is energized to increase the pressure applied to the fluid developing agent 18 so that the fluid developing agent 18 uniformly protrudes out of the slot 25 by a protrusion amount P of about 0.5 mm.

According to the present embodiment, the protruding amount of the fluid developing agent 18 can be thus controlled both roughly and finely. It therefore becomes possible to adjust the amount of the fluid developing agent 18 adhered to the surface of the photosensitive drum 12 both roughly and finely. It becomes possible to easily adjust density of the developed image.

It is noted that the image developing part 10 is placed relative to the photosensitive drum 12 so that the tip ends of the flat plates 24a and 24b are not in contact with the surface of the photosensitive drum 12. While the minute displacement actuator 28 is not activated, the pressure is applied only from the pressure adjusting valve 30 so that a tip end (meniscus) of the fluid developing agent 18 does not protrude from the slot 25 as shown in FIG. 2. The tip of the fluid developing agent 18 does not contact with the surface of the photosensitive drum 12. When the minute displacement actuator 28 is activated, the pressure is adjusted by both the valve 30 and the actuator 28 so that the tip end (meniscus) of the fluid developing agent 18 protrudes from the slot 25 and is brought into contact with the surface of the photosensitive drum 12.

A set of fluid resistance plates 34 is provided inside the tank 32 in front of the chamber 23. The fluid resistance plates 34 are for applying fluid resistance to the fluid developing agent 18 which is being supplied to the chamber 23. Accordingly, a large change in the pressure attained by the valve 30 will not directly affect the fluid developing agent 18 located in the chamber 23. There is no possibility that the fluid developing agent 18 will leak out of the slot 25 even if the valve 30 performs a rapid change in pressure.

With the above-described structure, when desiring to develop the electrostatic latent image on the photosensitive drum 12, the minute displacement actuator 28 is actuated. As a result, the fluid developing agent 18 protrudes from the slot 25 and is brought into contact with the surface of the photosensitive drum 12. The negatively-charged fluid developing agent 18 adheres to a region of the photosensitive drum 12 which has an electric potential of a small absolute value. Accordingly, the electrostatic latent image is made visible with the fluid developing agent 18.

It is noted that the fluid developing agent 18 is preferably non-volatile so that it does not congeal, when it dries, at the slot 25 or between the flat plates 24a and 24b. It is preferable that the fluid developing agent 18 has a volume resistance within a range between $10^5$ Ω•cm and $10^{14}$ Ω•cm, for example, in order that a sufficient electric charge will be induced in the fluid developing agent 18 due to the electric voltage applied between the electrodes 26a and 26b.

The image transferring part 3 is provided at a downstream side of the image developing part 10 in the rotating direction of the photosensitive drum 12. The image transferring part 3 is constructed from an image transfer roller 40. The image transfer roller 40 is made from a conductive rubber such as silicon rubber. A fixed value of electric voltage is applied to the image transfer roller 40. The fluid developing agent 18 adhered to the photosensitive drum 12 is transferred from the photosensitive drum 12 to a recording sheet 38 which is being delivered between the image transfer roller 40 and the photosensitive drum 12.

In the present embodiment, a positive electric voltage is applied to the image transfer roller 40. Accordingly, the negatively charged fluid developing agent 18, adhered to the photosensitive drum 12, is electrostatically attracted in a direction toward the image transfer roller 40, and adheres to the recording sheet 38.

Normally, an ordinary paper is used as the recording sheet 38. OHP sheets, and other types of sheets can be used as the recording sheet 38.

With the above-described structure, the image forming apparatus 1 operates as described below.

Normally, the valve 30 is set to control the pressure applied to the fluid developing agent 18 so that the fluid developing agent 18 is kept in a stable condition in which the tip end (meniscus) of the fluid developing agent 18 does not protrude out of the slot 25 as shown in FIG. 2.

When an instruction for printing is issued by a control mechanism (not shown in the drawing), a fixed value of a negative electric voltage is applied to the scorotron charger 14. Then, the photosensitive drum 12 starts rotating in the direction indicated by the arrow in the drawings. In the laser scanner 16, the semiconductor laser (not shown) is controlled according to image data to emit laser light, and the deflector (also not shown) deflects the laser light onto the surface of the photosensitive drum 12. Consequently, an electrostatic latent image is formed on the surface of the photosensitive drum 12.

At the image developing part 10, the minute displacement actuator 28 is actuated so that the valve 30 and the actuator 28 both apply pressure to the fluid developing agent 18. As a result, a small amount (approximately 0.5 mm) of the fluid developing agent 18 uniformly protrudes through the slot 25 from the chamber 23 as shown in FIG. 1. As a result, a tip of the developing agent 18 is brought into contact with the surface of the photosensitive drum 12. The fluid developing agent 18 adheres only to the parts of the surface of the photosensitive drum 12 whose electric potential has a small absolute value. Because the slot 25 extends over the entire width of the photosensitive drum 12, the fluid developing agent 18 selectively adheres to the photosensitive drum 12 over the entire width thereof. As the photosensitive drum 12 rotates, the electrostatic latent image is successively developed with the fluid developing agent 18.

Then, the image transfer roller 40 transfers the fluid developing agent 18 from the surface of the photosensitive drum 12 to the recording sheet 38, which is being delivered between the photosensitive drum 12 and the image transfer roller 40. The transferred fluid developing agent 18 is then fixed on the recording sheet 38 with the use of the image fixing mechanism (not shown in the drawings.) Then, the recording sheet is discharged out of the apparatus 1 as a hard copy.

When the development operation is thus completed, application of the electric voltage to the minute displacement actuator 28 is stopped. The pressure applied to the fluid developing agent 18 is reduced. As a result, the tip end (meniscus) of the fluid developing agent 18 recedes into the chamber 23 as shown in FIG. 2.

As described above, the pressure applying valve 30 and the minute displacement actuator 28 can control the protrusion amount of the fluid developing agent 18. Accordingly, the fluid developing agent 18 is kept under a stable condition so that the fluid developing agent 18 will not drip out of the tank 32. The internal part of the apparatus 1 will not be contaminated with the fluid developing agent 18. More specifically, while printing is performed, the fluid developing agent 18 is kept in a first stable condition (shown in FIG. 1) where a tip end of the fluid developing agent 18 protrudes out of the slot 25 while not dripping out of the slot 25. While printing is not performed, the fluid developing agent 18 is kept in a second stable condition (shown in FIG. 2) where a tip end of the fluid developing agent 18 does not protrude from the slot 25. Because the slot 25 is very narrow and has a small gap or height H of about 0.1 mm, the amount of the fluid developing agent 18, which volatilizes through the slot 25, is extremely small. The smell associated with the volatilization is remarkably reduced.

It is therefore unnecessary to use devices such as a filter for absorbing smell. It is also unnecessary to use devices for removing developing liquid remaining on a developing roller as used in conventional apparatuses. The entire image forming apparatus 1 can be made small and light and, as a result, it becomes possible to reduce the cost for producing the entire apparatus 1.

As described above, according to the present embodiment, the image developing part 10 is constructed from the developing agent storing part 20 storing the fluid developing agent 18 and the developing agent supplying part 22 confronting the surface of the photosensitive drum 12 via the minute opening 25. The developing agent supplying part 22 includes a pair of, upper and lower, flat plates **24*a* and 24*b* which are placed in parallel and which define the uniform minute opening 25 extending over the entire width of the photosensitive drum 12. The flat plates 24*a* and 24*b* are formed with the electrodes 26*a* and 26*b*, respectively. It is possible to finely adjust the distance between the flat plates 24*a* and 24*b* through operating the minute displacement actuator 28 placed at the gap between the flat plates 24*a* and 24*b*. It is therefore possible to control the pressure to be exerted upon the fluid developing agent 18**.

While the invention has been described in detail with reference to the specific embodiment thereof, it would be apparent to those skilled in the art that various changes and modifications may be made therein without departing from the spirit of the invention.

Figure 4:
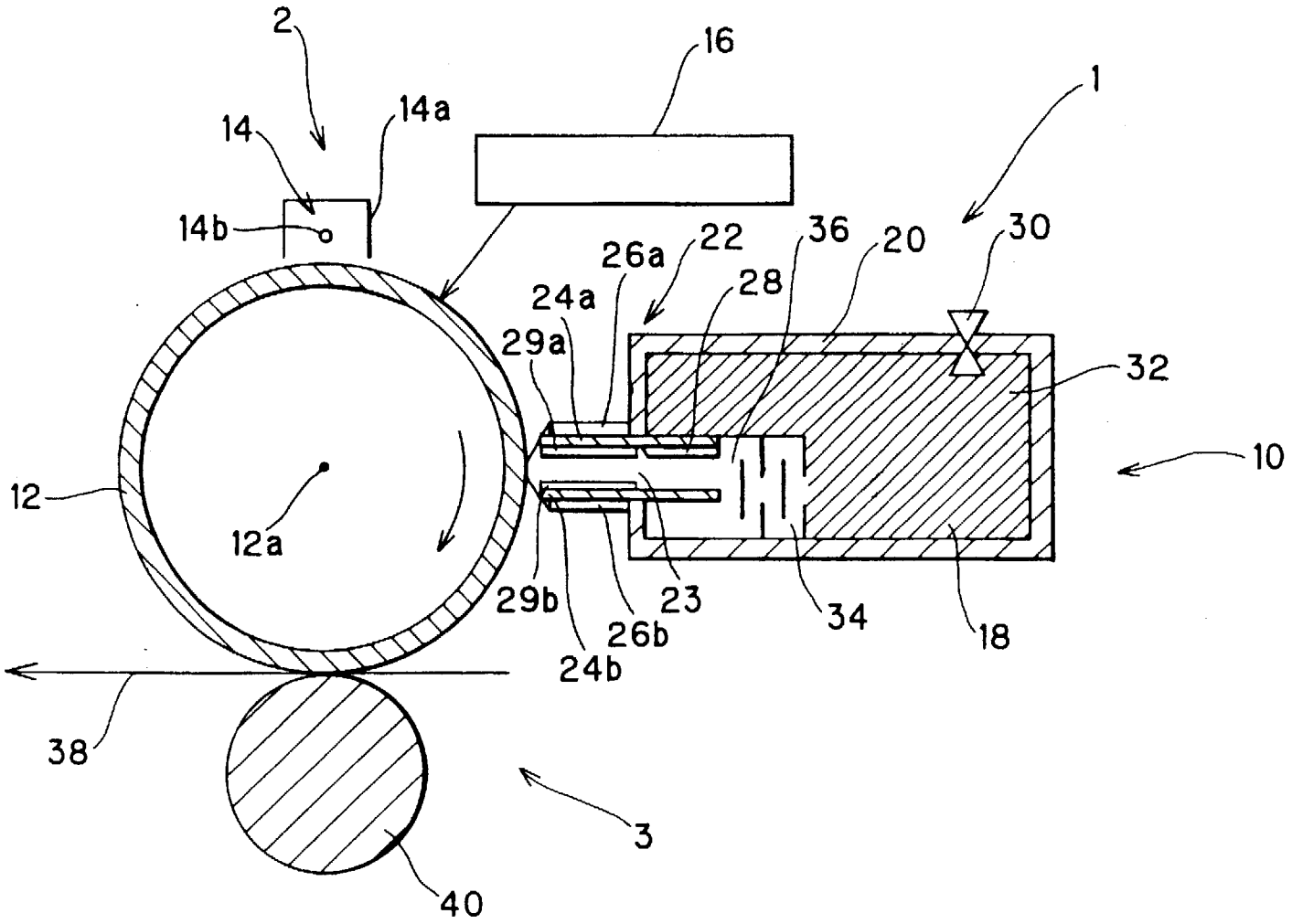
FIG. 4 is a sectional view of an image developing apparatus according to a modification of the present invention wherein a fluid developing agent protrudes from a slot during a developing operation.

In the above-described embodiment, in order to control the protruding amount of the fluid developing agent 18, the pressure applied to the fluid developing agent 18 is finely controlled through changing the distance between the flat plates **24*a* and 24*b* with the minute displacement actuator 28. However, it is also possible to control the protruding amount by changing an electrostatic force applied to the fluid developing agent 18. In order to control the electrostatic force, as shown in FIG. 4, electrodes 29*a* and 29*b* may be provided to the internal side surfaces of the flat plates 24*a* and 24*b*, that is, a lower surface of the upper flat plate 24*a* and an upper surface of the lower flat plate 24*b*. An electric voltage applied to the electrodes 29*a* and 29*b* is adjusted to control an electric field established between the photosensitive drum 12 and the electrodes 29*a* and 29*b*, whereupon the protrusion amount of the fluid developing agent 18 is controlled. In the above-described example where the photosensitive drum 12 and the fluid developing agent 18 are both charged negatively, an electric voltage of a negative polarity may also be applied to each of the electrodes 29*a* and 29*b*. During the developing operation, the absolute value of the applied electric voltage is made large, so that a large amount of electric field is established between the photosensitive drum 12 and the electrodes 29*a* and 29*b*. The fluid developing agent 18 will protrude out of the slot 25 similarly as shown in FIG. 1. On the other hand, not during the developing operation, the absolute value of the applied electric voltage is made small, so that a smaller amount of electric field is established between the photosensitive drum 12 and the electrodes 29*a* and 29*b*. The fluid developing agent 18 will not protrude out of the slot 25 similarly as shown in FIG. 2**.

In the above-described embodiment, the scorotron charger 14 is employed to electrically charge the photosensitive drum 12 uniformly. However, a well-known charging roller can be employed in place of the above-mentioned scorotron charger. The charging roller can be constructed from, for example, a conductive rubber (silicon rubber). The charging roller electrically charges the surface of the photosensitive drum 12 uniformly when the charging roller is applied with a fixed value of high electric potential.

A well-known LED array or LCD shutter device can be used in place of the laser scanner 16.

In the above-described embodiment, the image development operation is conducted through a so-called reversal development method wherein a portion, to which light is irradiated, is adhered with fluid developing agent. However, an image development operation can be conducted via a normal development method when the photosensitive drum 12 is electrically charged into a positive polarity. In this case, the image forming apparatus 1 can be used as a copying machine.

A well-known scorotron-type transferring equipment can also be used in place of the image transfer roller 40.

In the present embodiment, an electrostatic latent image is formed on the photosensitive drum 12, and the electrostatic latent image is made visible with the fluid developing agent 18. However, the electrostatic latent image may be formed on a special paper having a photosensitive characteristic. In this case, a transfer mechanism such as the image transfer roller 40 becomes unnecessary. It becomes possible to make the apparatus smaller and lighter.

As described above, the image developing apparatus of the present invention includes an image bearing body having a predetermined recording width and bearing an electrostatic latent image. The image bearing body moves in a direction almost perpendicular to the widthwise direction. The developing agent supplying device is provided confronting the surface of the image bearing body to supply fluid developing agent to the image bearing body. The developing agent supplying device includes a uniform minute opening which is provided nearly in parallel to the widthwise direction. The developing agent supplying device further includes a developing agent protruding mechanism for making the fluid developing agent uniformly protrude out of the minute opening in a very small amount along the widthwise direction. The electrostatic latent image formed on the image bearing body is made visible with the fluid developing agent protruded from the minute opening.

With this structure, the fluid developing agent does not leak out when it is not in use. The internal part of the apparatus is therefore not contaminated with the fluid developing agent. The developing agent protrudes only during a developing operation because the developing agent protruding mechanism controls the amount of the fluid developing agent protruding from the minute opening.

Because the fluid developing agent protrudes by a very small amount through the minute opening, the amount of the fluid developing agent which volatilizes or vaporizes is extremely small. It is therefore possible to reduce remarkably the smell associated with the volatilization or vaporization of the fluid developing agent. It becomes unnecessary to provide any mechanism for preventing smell and leak of fluid developing agent. The entire image forming apparatus becomes small and light.

The image developing agent protruding mechanism adjusts the protrusion amount of the fluid developing agent into a first condition in which a tip of the fluid developing agent is in contact with the surface of the image bearing body and into a second condition in which the fluid developing agent is not in contact with the surface of the image bearing body. The electrostatic latent image on the image bearing body is made visible when the fluid developing agent is under the first condition.

With this structure, the fluid developing agent can be maintained in the second condition while the developing operation is not performed. The fluid developing agent can be kept under a stable condition where it does not leak out under various conditions including its surface tension, viscosity and the distance between the pair of flat plates. There is no possibility that the internal part of the apparatus is contaminated with the fluid development agent.

Because the fluid developing agent contacts the surface of the image bearing body during the development operation only, it is possible to save the amount of the fluid developing agent.

The developing agent protruding mechanism includes a first controlling mechanism for controlling pressure applied to the fluid developing agent and a second controlling mechanism for controlling the pressure applied to the fluid developing agent more precisely than the first controlling mechanism. It is therefore possible to control the protruding amount of the fluid developing agent both precisely and roughly and thus it is possible to easily adjust the density of a developed image.

The condition of the fluid developing agent is adjusted into one of the first and second conditions with the use of the second controlling mechanism. It is therefore possible to control more accurately the state of the fluid developing agent in contact/not in contact with the image bearing body through adjusting its protrusion amount.

What is claimed is:

1. An image developing apparatus for developing a latent image into a visible image, the apparatus comprising:

an image bearing body for bearing an electrostatic latent image, the image bearing body having a predetermined recording width, the image bearing body moving in a direction substantially perpendicular to the widthwise direction; and developing agent supplying means placed confronting the surface of the image bearing body for supplying fluid developing agent to the image bearing body, the developing agent supplying means including means for defining a uniform minute opening extending substantially in parallel to the widthwise direction and developing agent protruding means capable of making the fluid developing agent uniformly protrude out of the minute opening along the widthwise direction, the opening defining means including a pair of flat plates which form a small gap therebetween for receiving the fluid developing agent, the pair of flat plates extending substantially parallel to the widthwise direction, the pair of flat plates having tip ends confronting the image bearing body, the tip ends defining the minute opening therebetween, the developing agent protruding means including adjusting means for adjusting force applied to the developing agent located in the small gap between the pair of flat plates, thereby controlling an amount of the fluid developing agent protruding from the minute opening into a first condition in which the fluid developing agent is in contact with the surface of the image bearing body and into a second condition in which the fluid developing agent is out of contact with the surface of the image bearing body.

2. An image developing apparatus as claimed in the claim 1, wherein the developing agent protruding means includes controlling means for controlling pressure applied to the fluid developing agent.

3. An image developing apparatus as claimed in the claim 2, wherein the controlling means includes first controlling means for controlling pressure applied to the fluid developing agent and second controlling means for controlling the pressure applied to the fluid developing agent more precisely than the first controlling means.

4. An image developing apparatus as claimed in claim 3, wherein the second controlling means controls the condition of the fluid developing agent into one of the first and second conditions.

5. An image developing apparatus as claimed in the claim 1, wherein the developing agent protruding means includes electrostatic force controlling means for controlling electrostatic force applied to the fluid developing agent.

6. An image developing apparatus as claimed in the claim 1, wherein the developing agent protruding means includes distance adjusting means for adjusting a distance between the pair of flat plates to thereby changing a pressure applied to the fluid developing agent, the distance adjusting means controlling an amount of the fluid developing agent protruding from the minute opening into a first condition in which the fluid developing agent is in contact with the surface of the image bearing body and into a second condition in which the fluid developing agent is out of contact with the surface of the image bearing body.

7. An image developing apparatus as claimed in the claim 6, wherein the developing agent supplying means includes:

a tank for storing the fluid developing agent; and a pressure applying valve for controlling a pressure applied to the fluid developing agent stored in the tank.

8. An image developing apparatus as claimed in the claim 1, wherein the developing agent supplying means includes means for electrically charging the fluid developing agent.

9. An image developing apparatus as claimed in the claim 8, wherein the image bearing body bears thereon a pattern of a surface electric potential, the electrically-charged fluid developing agent, contacted to the surface of the image bearing body, being selectively adhered to the image bearing body dependent on the surface electric potential.

10. An image developing apparatus as claimed in the claim 9, further comprising:

means for electrically charging the image bearing body to have a uniform electric potential; and light exposing means for selectively exposing the image bearing body to light so that the electric potential changes.

11. An image developing apparatus as claimed in the claim 1, wherein the pair of flat plates extend over an entire width of the image bearing body, thereby allowing the minute opening to extend over the entire width of the image bearing body.

12. The image developing apparatus as claimed in claim 1, wherein the amount of the fluid developing agent protruding from the minute opening when controlled into the first condition is maintained in a stable condition.

13. An image developing apparatus for developing a latent image into a visible image, the apparatus comprising:

an image bearing body for bearing an electrostatic latent image;

means for defining a minute opening confronting the image bearing body, the opening defining means including a pair of flat plates which form a small gap therebetween for receiving fluid developing agent, the pair of flat plates extending substantially parallel to the image bearing body, the pair of flat plates having tip ends confronting the image bearing body, the tip ends defining the minute opening therebetween; and developing agent protruding means for controlling fluid developing agent to protrude out of the minute opening into contact with the image bearing body, the developing agent protruding means including adjusting means for adjusting force applied to the developing agent located in the small gap between the pair of flat plates, thereby controlling an amount of the fluid developing agent protruding from the minute opening into a first condition in which the fluid developing agent is in contact with the surface of the image bearing body and into a second condition in which the fluid developing agent is out of contact with the surface of the image bearing body.

14. An image developing apparatus as claimed in the claim 13, wherein the adjusting means controls a pressure applied to the fluid developing agent to thereby adjust the protruding amount.

15. An image developing apparatus as claimed in the claim 13, wherein the pair of flat plates extend over an entire width of the image bearing body, thereby allowing the minute opening to extend over the entire width of the image bearing body.

16. The image developing apparatus as claimed in claim 13, wherein the amount of the fluid developing agent protruding from the minute opening when controlled into the first condition is maintained in a stable condition.

17. An image developing apparatus for developing a latent image into a visible image, the apparatus comprising:

an image bearing body for bearing an electrostatic latent image, the image bearing body having a predetermined recording width, the image bearing body moving in a direction substantially perpendicular to the widthwise direction; and developing agent supplying means placed confronting the surface of the image bearing body for supplying fluid developing agent to the image bearing body, the developing agent supplying means including means for defining a uniform minute opening extending substantially in parallel to the widthwise direction and developing agent protruding means capable of making the fluid developing agent uniformly protrude out of the minute opening along the widthwise direction, wherein the developing agent protruding means includes adjusting means for adjusting an amount of the fluid developing agent protruding from the minute opening into a first condition in which the fluid developing agent is in contact with the surface of the image bearing body and into a second condition in which the fluid developing agent is out of contact with the surface of the image bearing body, wherein the adjusting means includes controlling means for controlling pressure applied to the fluid developing agent, the controlling means including first controlling means for controlling pressure applied to the fluid developing agent and second controlling means for controlling the pressure applied to the fluid developing agent more precisely than the first controlling means.

18. An image developing apparatus as claimed in claim 17, wherein the second controlling means controls the condition of the fluid developing agent into one of the first and second conditions.

19. The image developing apparatus as claimed in claim 17, wherein the amount of the fluid developing agent protruding from the minute opening when controlled into the first condition is maintained in a stable condition.

20. An image developing apparatus for developing a latent image into a visible image, the apparatus comprising:

an image bearing body for bearing an electrostatic latent image, the image bearing body having a predetermined recording width, the image bearing body moving in a direction substantially perpendicular to the widthwise direction; and developing agent supplying means placed confronting the surface of the image bearing body for supplying fluid developing agent to the image bearing body, the developing agent supplying means including means for defining a uniform minute opening extending substantially in parallel to the widthwise direction and developing agent protruding means capable of making the fluid developing agent uniformly protrude out of the minute opening along the widthwise direction, wherein the developing agent protruding means includes adjusting means for adjusting an amount of the fluid developing agent protruding from the minute opening into a first condition in which the fluid developing agent is in contact with the surface of the image bearing body and into a second condition in which the fluid developing agent is out of contact with the surface of the image bearing body, the adjusting means including electrostatic force controlling means for controlling electrostatic force applied to the fluid developing agent.

21. The image developing apparatus as claimed in claim 20, wherein the amount of the fluid developing agent protruding from the minute opening when controlled into the first condition is maintained in a stable condition.

* * * * *